US007376999B2

(12) United States Patent
Haft

(10) Patent No.: US 7,376,999 B2
(45) Date of Patent: May 27, 2008

(54) SLIPPER HAVING SHAPE MEMORY

(75) Inventor: Rita Magidson Haft, Beverly Hills, CA (US)

(73) Assignee: Metric Products, Inc., Culver City, CA (US)

( * ) Notice: Subject to any disclaimer, the term of this patent is extended or adjusted under 35 U.S.C. 154(b) by 0 days.

(21) Appl. No.: 11/592,860

(22) Filed: Nov. 3, 2006

(65) Prior Publication Data

US 2007/0051015 A1 Mar. 8, 2007

Related U.S. Application Data

(62) Division of application No. 11/038,891, filed on Jan. 19, 2005, now Pat. No. 7,162,813.

(51) Int. Cl.
*A43B 3/10* (2006.01)
*A43B 3/24* (2006.01)

(52) U.S. Cl. ..... 12/142 S; 36/9 R; 36/102

(58) Field of Classification Search ..... 12/142 S; 36/9 R, 26, 102
See application file for complete search history.

(56) References Cited

U.S. PATENT DOCUMENTS

| | | | | |
|---|---|---|---|---|
| 2,803,894 | A * | 8/1957 | Morgan | 36/11.5 |
| 3,015,170 | A | 1/1962 | Kramer | |
| 3,016,631 | A | 1/1962 | Servin | |
| D402,796 | S | 12/1998 | Garcia et al. | |
| D505,537 | S * | 5/2005 | Friedman | D2/961 |
| 2002/0152639 | A1 | 10/2002 | Otis | |

FOREIGN PATENT DOCUMENTS

| | | | |
|---|---|---|---|
| DE | 20120302 | U1 | 2/2002 |
| JP | 2002/282002 | A | 10/2002 |

* cited by examiner

*Primary Examiner*—Ted Kavanaugh
(74) *Attorney, Agent, or Firm*—Blakely, Sokoloff, Taylor & Zafman LLP

(57) ABSTRACT

A slipper has an upper portion. The upper portion is flexible. A lower portion is connected to the upper portion. The upper portion and the lower portion include ribbed formations. The upper portion and the lower portion are made of a material having shape memory.

4 Claims, 2 Drawing Sheets

FIG. 3
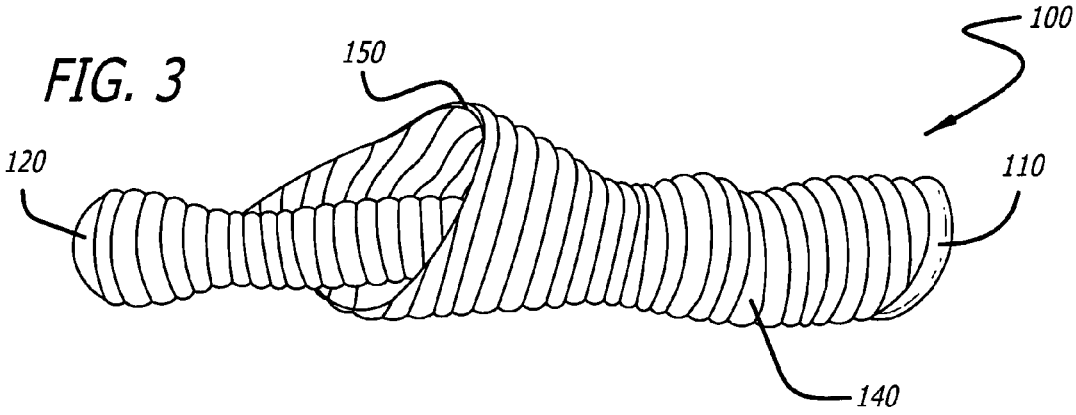
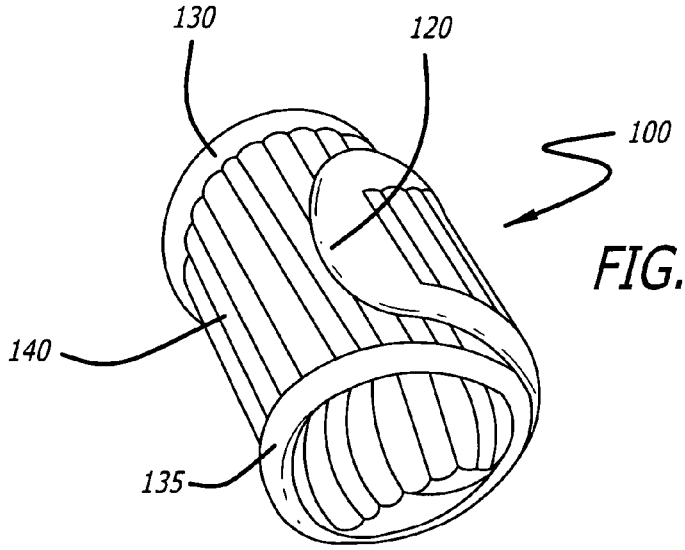
FIG. 4
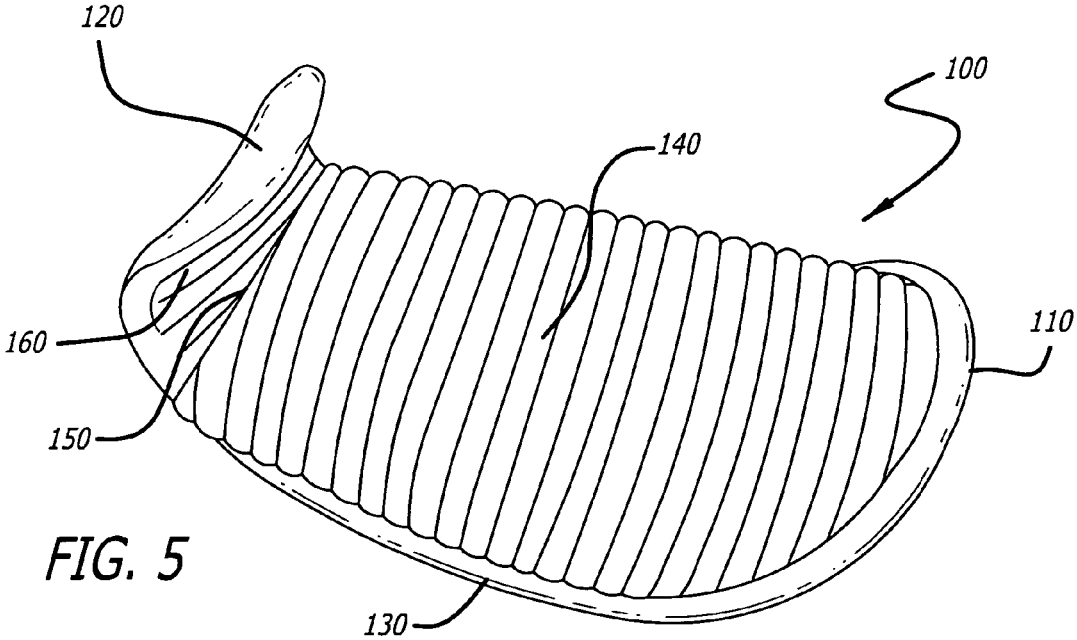
FIG. 5

SLIPPER HAVING SHAPE MEMORY

The application is a Divisional of U.S. patent application Ser. No. 11/038,891, filed Jan. 19, 2005, entitled "SLIPPER HAVING SHAPE MEMORY" now U.S. Pat. No. 7,162,813.

BACKGROUND

1. Field

The embodiments relate to slippers, and more particularly to travel slippers made with material having shape memory.

2. Description of the Related Art

There are many slippers on the market today that serve the purpose of comfort, relaxation and that protect a person's bare or sock worn foot. Slippers can be used in many places and for many reasons. The existing slippers, however, have some limitations. One of these limitations is that the existing slippers cannot be stored in confined places. As travel vehicles become more stringent in allowing on-board items, the ability to store travel items in smaller more convenient places becomes more necessary.

SUMMARY

One embodiment includes a slipper having an upper portion. The upper portion being flexible. A lower portion is coupled to the upper portion. The upper portion and the lower portion including a plurality of ribbed formations, the upper portion and the lower portion made of a material having shape memory.

Another embodiment includes forcing a slipper from a first shape to a second shape. Removing a force applied to the slipper. Wherein the slipper returns to the first shape when the force is removed from the slipper.

Still another embodiment includes a slipper comprising a cover and a lower portion. The cover and the lower portion are contiguous. The cover and the lower portion include a plurality of ribbed formations. The upper portion and the lower portion are made of a material having shape memory and the ribbed formations are molded into the slipper.

BRIEF DESCRIPTION OF THE DRAWINGS

The embodiments discussed herein generally relate to slippers having shape memory. Referring to the figures, exemplary embodiments will now be described. The exemplary embodiments are provided to illustrate the embodiments and should not be construed as limiting the scope of the embodiments.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

FIG. 3 illustrates the embodiment illustrated in FIG. 1 rolled from one side edge to another side edge.

FIG. 4 illustrates the embodiment illustrated in FIG. 1 rolled from one end to another end.

FIG. 5 illustrates the embodiment illustrated in FIG. 1 having a rear portion flexed inward.

DETAILED DESCRIPTION OF THE INVENTION

The invention generally relates to slippers having shape memory. Referring to the figures, exemplary embodiments of the invention will now be described. The exemplary embodiments are provided to illustrate the invention and should not be construed as limiting the scope of the invention.

Figure 1:
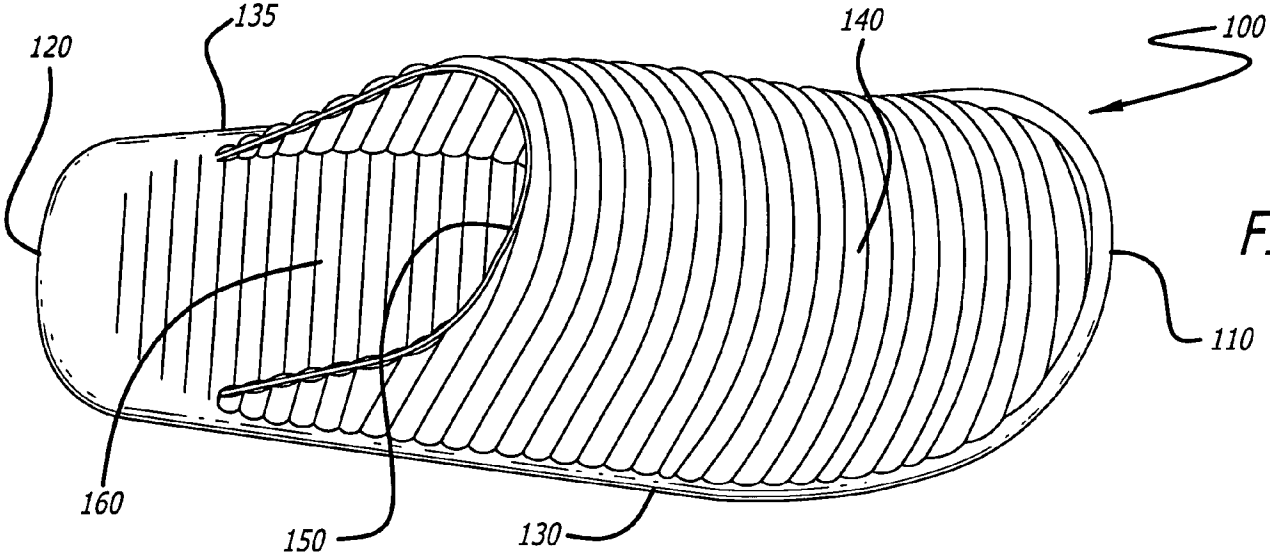
FIG. 1 illustrates a top view of an embodiment of the invention having molded ribbed portions.

FIG. 1 illustrates a top view of embodiment of slipper 100. Slipper 100 includes front portion 110, rear portion 120, first edge 130, second edge 135, top lower portion 160 and cover portion 150. Slipper 100 includes a plurality of ribbed formations 140 where a groove exists between each of the ribbed formations. The ribbed formations allow folding or rolling slipper 100 into a much smaller and storable item. It should be noted that the number of ribbed formations 140 depends on the size of slipper 100. That is, the larger shoe size of slipper 100, the larger number of ribbed formations 140 included in slipper 100.

In one embodiment slipper 100 is made of material having shape memory. Slipper 100 can be comprised of suitable man-made material that can be formed over an inner portion lying between a top portion and a bottom portion that is comprised of suitable compressible material, such as a foam polymer type material. The composition of the top portion, bottom portion and the inner portion lying between top portion and the bottom portion are such that slipper 100 can be formed by a heat source in a press which molds the composite materials. Since slipper 100 is comprised of molded material, slipper 100 has shape "memory." Therefore, slipper 100 can be folded, twisted, washed, etc., and will retain its original formed shape.

Figure 2:
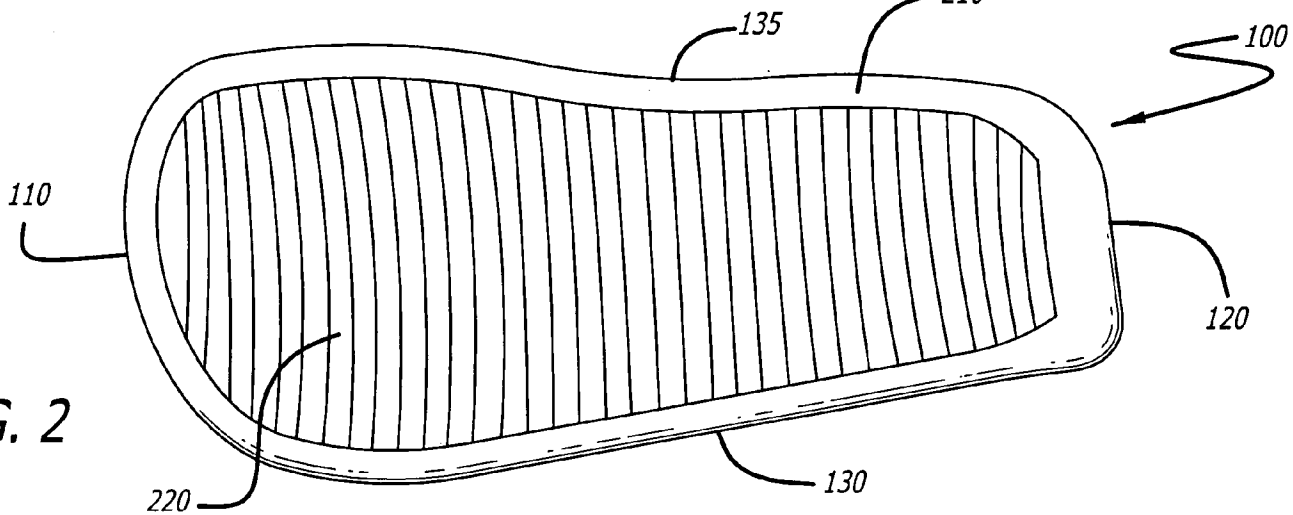
FIG. 2 illustrates a bottom view of the embodiment illustrated in FIG. 1.

FIG. 2 illustrates a bottom view of slipper 100. In one embodiment slipper 100 includes an outer perimeter 210. Outer perimeter 210 gives stability to slipper 100. Slipper 100 is formed by Slipper 100 includes bottom portion 220. In one embodiment slipper 100 is formed from one contiguous molded material formed by heat and pressure applied to the material.

FIG. 3 illustrates slipper 100 rolled up from side to side, for example from first edge 130 to second edge 135, or vice versa. Ribbed formations 140 allow slipper 100 to be collapsible, rollable and compacted into various shapes so that slipper 100 can be stored in various places, such as a pocket of a clothing item, a suitcase, a carry-on bag, a pocket book, etc. Since slipper 100 can be forced into various shapes and sizes, slipper 100 is easily stowed when traveling on a vehicle, such as an airplane, a ship or boat, a bus or car, a motorcycle, a train, etc. With slipper 100 being formed of a memory shape material, when slipper 100 is removed from a stored location, slipper 100 returns to its original shape automatically. It should be noted that when slipper 100 is placed under a force, such as a persons hands clasping or squishing slipper 100, air is removed from the foam polymer layer. This reduces the volume of the foam polymer allowing slipper 100 to displace less volume. When the force is removed, air fills spaces in the foam polymer returning slipper 100 back to its original displacement and original shape.

FIG. 4 illustrates slipper 100 in a rolled up shape. As illustrated, slipper 100 is rolled up, for example, from front portion 110 to end portion 120, or vice versa. As can be seen from FIG. 4, when slipper 100 is forced into a rolled-up form, slipper 100 can easily be stored into a small spaced area. It should be noted that slipper 100 can be forced into many different shapes to store in many different types of places.

FIG. 5 illustrates slipper 100 having rear portion 120 flexed upwards. As illustrated, slipper 100 is extremely flexible. In one embodiment ribbed formations 140 have a thickness of ⅛ of an inch. In other embodiments, ribbed formations 140 can be made to other proportional thicknesses, such as ¼ inch, ½ inch, etc. It should be noted that the thicker ribbed formations 140 are, the more cushioning slipper 100 has.

In one embodiment slipper 100 has an arched shape from first edge 130 to second edge 140. In this embodiment, when slipper 100 is worn by a person, slipper 100 flattens out according to the shape of a person's foot. In this embodiment, slipper 100 adapts to various arch structures of feet to improve comfort.

In one embodiment cover portion 150 is stretchable to ensure a good fit to a person's foot. In this embodiment, cover portion 150 stretches outward to provide a tighter fit to a person's foot so that slipper 100 is less likely to fall or slip off when a person walks. In this embodiment when slipper 100 is removed from a person's foot, slipper 100 returns to its original form due to the shape memory characteristics of the material slipper 100 is made of.

In another embodiment slipper 100 is made such that ribbed formations 140 are thicker at the rear portion (placement where a person's heel would be situated) and the front portion (placement where a person's toes would be situated) to improve comfort and support. In yet another embodiment, ribbed formations do not exist at the front and rear portions of slipper 100. In this embodiment, instead of ribbed formations 140, slipper 100 includes a heel portion and a toe portion having a thicker flat shape to improve comfort and support of a person's foot.

In another embodiment slipper 100 is formed by heat molding an upper portion to a lower portion. In this embodiment, slipper 100, once molded, becomes one contiguous slipper. In another embodiment slipper 100 is formed by heat molding a foam polymer in between layers of fabric. In this embodiment slipper 100 is formed of one piece.

Slipper 100 can vary in dimension so as to accommodate various foot shapes and sizes. As illustrated in FIGS. 1-4, slipper 100 is worn by a person by slipping a foot into slipper 100. In another embodiment, slipper 100 has a back portion and a heel-fit portion as a typical shoe-type slipper has (not shown). In this embodiment, slipper 100 is worn by a person by placing a foot in slipper 100, and using a tool, such as a shoe-corn, or a finger (s.).

In one embodiment, slipper 100 includes an arch portion (not shown) to support a person's arch of a foot. In this embodiment, the arch portion is formed by molding the arch portion from additional memory shape material.

It should be noted that cover portion 150 can vary in foot coverage portions, such as covering the top of a person's foot up to the ankle, or less, to assure that slipper 100 shall remain fixed to a person's foot to avoid slipper 100 from falling off when a person walks.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method of manufacturing a slipper comprising:

forming a first portion and a second portion by heat molding a foam polymer between a first layer of material and a second layer of material;

forming the slipper by heat welding the first portion to the second portion, wherein a plurality of ribbed formations are molded from the first layer, the second layer and a foam polymer, and the plurality of ribbed formations are parallel in relation to a width of the slipper and extending a length of the slipper.

2. The method of claim 1, wherein the slipper returns to its original shape when an applied force is removed from a rolled up slipper.

3. A method of manufacturing a slipper comprising:

forming a slipper by heat molding a foam polymer between a first layer of material and a second layer of material;

wherein a plurality of ribbed formations are molded from the first layer, the second layer and a foam polymer, the plurality of ribbed formations operate to allow the slipper to be rolled up, and the plurality of ribbed formations are parallel in relation to the width of the slipper and extending the length of the slipper.

4. The method of claim 3, wherein the slipper returns to its original shape when an applied force is removed from a rolled up slipper.

* * * * *